United States Patent [19]

Aral

[11] 4,421,068

[45] Dec. 20, 1983

[54] OPTIMIZATION OF STEAM DISTRIBUTION

[75] Inventor: Gurcan Aral, Cupertino, Calif.

[73] Assignee: Measurex Corporation, Cupertino, Calif.

[21] Appl. No.: 395,408

[22] Filed: Jul. 6, 1982

[51] Int. Cl.[3] ..... F22B 37/46; F22D 5/00

[52] U.S. Cl. ..... 122/448 B; 60/676; 122/1 R

[58] Field of Search ..... 122/448 R, 448 B, 1 R; 60/676

[56] References Cited

U.S. PATENT DOCUMENTS

| | | | |
|---|---|---|---|
| 3,387,589 | 6/1968 | Chan et al. | 122/1 R |
| 3,576,177 | 4/1971 | Block | 122/1 R |
| 4,069,675 | 1/1978 | Adler et al. | 122/448 B |
| 4,306,417 | 12/1981 | Binstock et al. | 60/676 |

*Primary Examiner*—Albert J. Makay
*Assistant Examiner*—Steven E. Warner
*Attorney, Agent, or Firm*—Hal J. Bohner

[57] ABSTRACT

A system and process is provided for controlling a steam generation and distribution system including a plurality of headers. Each of the headers is coupled to steam using devices such as steam turbines and steam supplying devices such as boilers. The process includes measuring the pressure at each header and when the pressure changes, identifying each path beginning at the particular header and terminating at a boiler, and determining the alteration of a boiler and any particular steam turbines required to restore the required pressure at the header while doing so at the least incremental cost.

5 Claims, 5 Drawing Figures

OPTIMIZATION OF STEAM DISTRIBUTION

BACKGROUND OF THE INVENTION

1. Field of The Invention

The present invention relates to a system and process for generating steam and supplying the steam to steam-using devices.

2. State of the Art

Steam needed for industrial processes is normally generated by boilers and then distributed via conduits called headers. Often steam-using devices in a facility require steam at various pressures and thus a steam distribution system often includes multiple headers at different steam pressures. The steam can be transferred from one header to another via turbines and partially expanded via the turbines to the desired pressure levels. During expansion through the turbines, some thermal steam energy is converted into mechanical energy and then, via generators, into electrical energy. The conversion of heat into electrical energy occurs with high efficiency, and therefore, partial expansion of steam in turbines and generation of electrical energy, called co-generation, is very popular.

The pressure at each header must be regulated, and the industry practice has often been such that, devices supplying a header are controlled to provide pressure regulation for that header. For example, boilers are regulated to control the pressure at the headers which they supply. Also, turbines have a pressure regulator at their extraction stages. And when a turbine is used to transfer steam from a high-pressure header to a lower pressure header, the pressure regulator is operated to control the pressure at the lower pressure header.

Computerized systems have been used to control boilers which supply a header. However, such systems have been limited in that they can control the steam pressure at only a single header without regard to the effects of such control upon the pressure in other headers.

OBJECT OF THE INVENTION

An object of the present invention is to provide a system and process to control the pressure at a plurality of steam headers. Another object is to control the pressure while assuring that steam is supplied at the least cost. Still another object is to control the boilers and turbines and other components of a steam supply and distribution system while minimizing the cost of the steam.

Further objects and advantages of the present invention can be ascertained with reference to the specification and drawing herein, which are offered by way of example only and not in limitation of the invention which is defined by the claims and equivalents thereto.

BRIEF DECRIPTION OF THE DRAWINGS

DETAILED DESCRIPTION OF THE PREFERRED EMBODIMENTS

Figure 1:
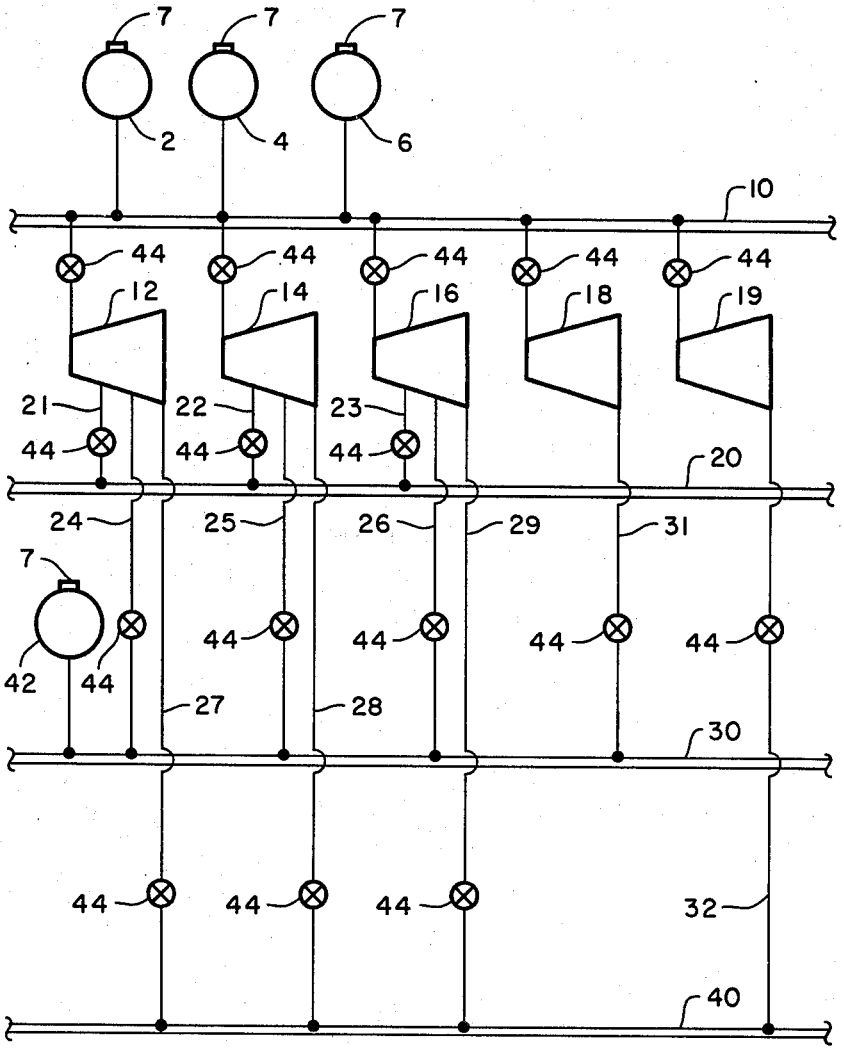
FIG. 1 is a schematic illustration of a steam generation and distribution system.

An exemplary cogeneration system is shown in FIG. 1. Three boilers 2, 4 and 6 are coupled to supply steam to a high pressure header 10. Each of the boilers includes a control system 7 to control the rate at which the boiler produces steam by controlling, among other things, the flow of fuel to the boiler. The header 10 is coupled to at least one steam-using device, not shown.

Five turbo-generators, or turbines, 12, 14, 16, 18 and 19 are coupled to the high pressure header 10. Three of the turbines 12, 14 and 16 have three extraction stages, and each extraction stage is connected to a separate outlet conduit. The conduits 21, 22 and 23 from the high pressure extraction stage of each turbine are coupled to supply steam to a first intermediate pressure header 20; the conduits 24, 25 and 26 from the intermediate pressure extraction stage are coupled to supply steam to a second intermediate pressure header 30; and the conduits 27, 28 and 29 from the low pressure extraction stage of each turbine are coupled to a low pressure header 40. The headers 20, 30 and 40 are each coupled to at least one steam-using device, not shown, to supply steam thereto.

Turbo-generator 18 has its output coupled to the second intermediate pressure header 30 via conduit 31 and the turbo-generator 19 has its output coupled to the low pressure header 49 via conduit 32. A boiler 42 having a control system 7 is coupled to supply steam at the second intermediate pressure to header 30.

Pressure regulators 44 are interposed in the conduits supplying steam to each turbine and also in the output conduits from the turbines. The pressure regulators 44 permit the pressures to be controlled at the various locations throughout the system.

It should be understood that the rate of steam production by each of the boilers 2, 4, 6 and 42 is controllable by operation of control systems 7. Also, for each boiler there is an incremental cost of producing steam which depends upon the price of fuel, the heat content thereof, the efficiency of the boiler and the load on the boiler.

$$\text{Incremental Cost} = \frac{\text{change in fuel cost}}{\text{change in steam}}$$

The turbines produce electricity and thus there is an incremental credit which can be determined for each turbine.

$$\text{Incremental Credit} = \frac{\text{change in electric power}}{\text{change in steam flow}} \times \text{Price of purchased electric power}$$

It is an object of the present invention to provide a process and system to operate a steam generation and distribution system of the type described above so that the total operating cost for the system is minimized. An embodiment of the system and process will be described hereinafter.

Figure 2:
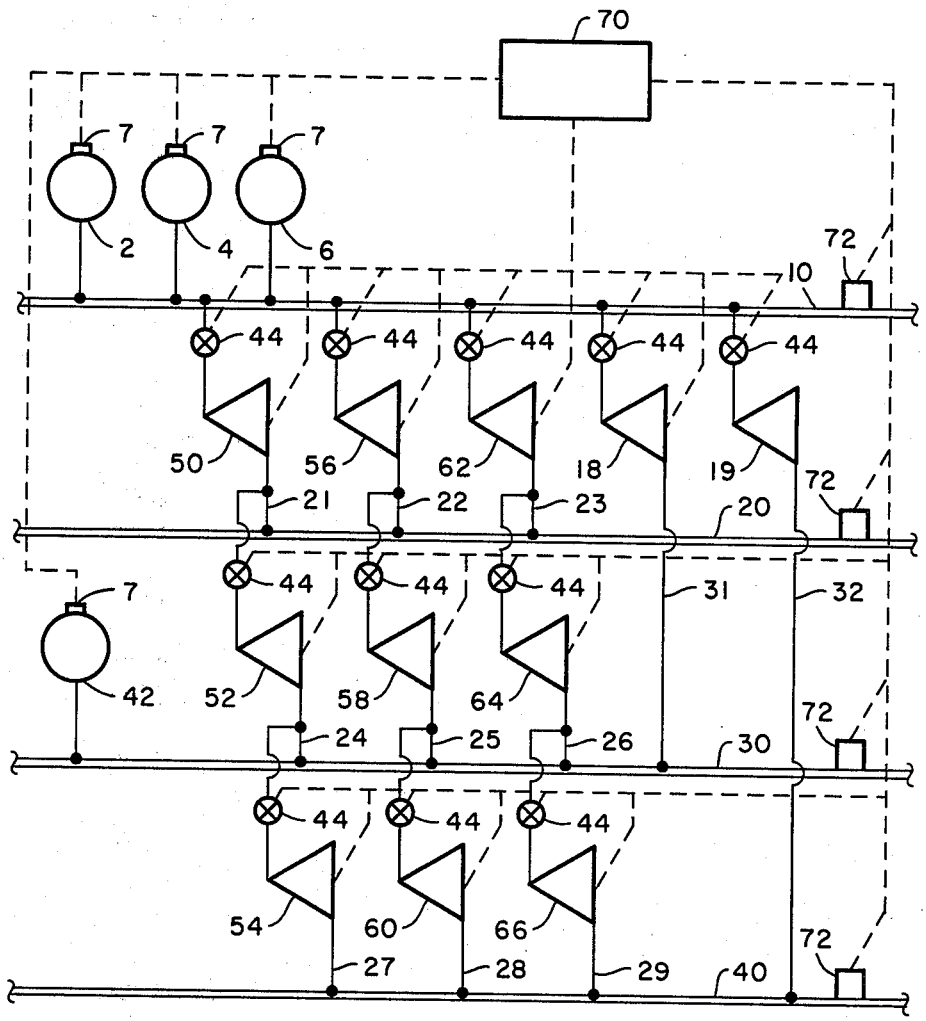
FIG. 2 is a schematic illustration of the method of the present invention applied to the system of FIG. 1.

The turbines 12, 14 and 16 have multiple extraction stages and thus each turbine can be thought of as three turbines with the output of one coupled to the input of another. In FIG. 2 this is illustrated so that the three stages of turbine 12 are illustrated respectively as turbines 50, 52 and 54. The output 21 of the first turbine 50 is coupled to header 20 and also to the input of turbine 52, while the output of turbine 52 is coupled to the header 30 and to the input of turbine 54, and the output of turbine 54 is coupled to header 40. Likewise, turbine 14 can be understood as turbines 56, 58 and 60, and turbine 16 can be understood as turbines 62, 64 and 66.

A computer 70 is provided to automatically carry out the process which will be described hereinafter. The computer 70 is coupled to receive signals from a plurality of pressure transducers 72 mounted one in each header. The computer 70 is also coupled to receive signals from the boiler control systems 7, the pressure regulators 44, and each of the turbines. Also each of the pressure regulators 44 has its own servo system, not shown, which converts signals from the computer 70 into mechanical motion to operate the regulator.

Figure 3:
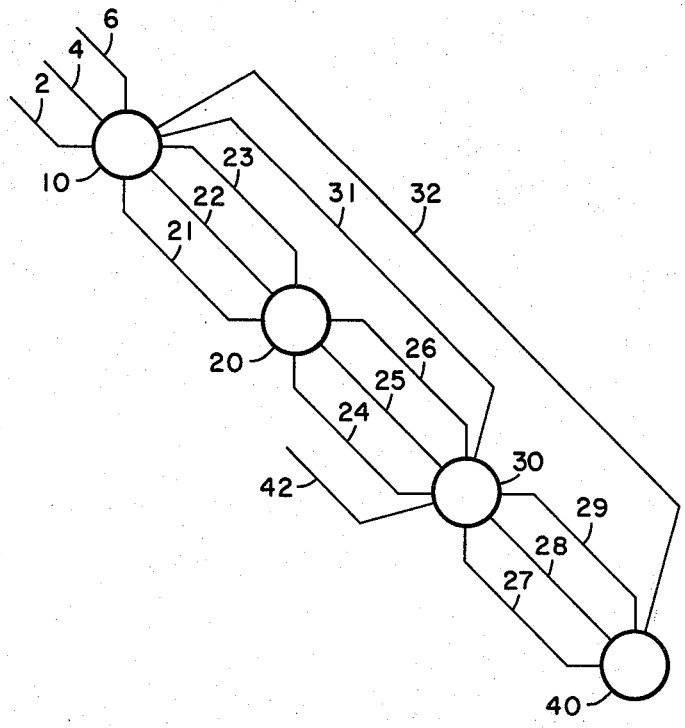
FIG. 3 is a schematic illustration of the network forming the system in FIG. 1.

The system shown in FIG. 2 can be conceptualized as the network shown in FIG. 3. In the network the headers are indicated as circles or nodes, 10, 20, 30 and 40 and the routes via which steam flows are indicated as lines. For simplicity, the elements of the network in FIG. 3 will be indicated by the numbers to which they correspond generally in the FIG. 2 system. However, it should be understood that there is not necessarily a direct correspondence between numbers in the network and elements of the FIG. 1 system. For example, item 21 in the network represents two pressure regulators 44, turbine 50 and conduit 21.

It can be seen that there are a plurality of paths connecting each node with another node. For example, node 20 is connected to node 10 via paths 21, 22 and 23. As another example, node 40 is connected to node 10 via a number of paths such as the major path comprising minor path 27, node 30, and minor path 31, or the minor path 28, node 30, minor path 26, node 20, minor path 23 and node 10.

Let us now assume that the system is operating and is stable, that is, steam is being produced at a constant rate and the pressures at the headers are stable at certain predetermined pressures through time. Also, the pressure transducers 72 are monitoring the pressure in each header and conveying the information to the computer 70. Now, the pressure at at least one header changes from the predetermined pressure and thus it becomes necessary to restore the pressure by altering certain turbines and boilers in the system. The present system accomplishes this as follows while minimizing the cost of steam used by the system.

(a) Select Header.

First, the computer selects a particular header in which the pressure has deviated from the predetermined pressure. Let us assume header 40 was selected.

(b) Path Identification.

Then the computer identifies each path which begins at the header in question, i.e., header 40, and terminates at a steam supply means, in this case boiler 2, 4, 6 or 42. The various paths can be seen in FIG. 3. Then the computer identifies each steam transfer means in each path. For example, in the path comprising minor path 27, node 30, minor path 31, node 10 and minor path 6, the identified transfer and steam supply means are turbines 54, and 18, which in fact represent the third extraction stage of turbine 12 and turbine 18, and boiler 6. As another example, in the path comprising node 40, minor path 28, node 30 and minor path 42 the identified transfer means is turbine 60, which in fact represents the third extraction stage of turbine 14 and boiler 42.

(c) Incremental Cost Determination.

After each transfer and supply means has been identified, the computer determines the incremental cost associated with each transfer means and with the supply means in each path. This is accomplished by utilizing information stored in the computer about the operating characteristics of each element of the system and the actual operating level of the element at the time, according to the equations set out above. It should be appreciated that in practice the computations may be far more complicated than suggested by the equations herein, which are merely illustrative. Next the incremental costs associated with each transfer means and supply means is totalled for each path to generate a path incremental cost for each path.

(d) Permissible Alteration Determination.

Thereafter the maximum permissible alteration for each transfer and supply means is determined based upon information about the various elements stored in the computer and about the existing condition of each element. For example, in a simple case, if a certain boiler can supply a maximum of 500 pounds of steam per hour and is presently supplying 450 pounds per hour, the maximum permissible alternative is an increase of 50 pounds per hour. However, as will be discussed below, the maximum permissible alteration can account for additional factors. That is, the present process includes the step of determining the alteration of a particular element necessary to produce a given steam pressure in a particular header, but, before this alteration is actually carried out, the alteration of the element necessary to achieve a predetermined pressure in other headers is also computed. This process is iterative. Thus, if the computer has accomplished, say, one iteration and it has been determined that an alteration of X units is necesssary to maintain the pressure at one header and in the next iteration the required alteration for maintenance of pressure at a second header is to be determined, during the second iteration the expected alteration of X units must be accounted for.

(e) Exclusion of Paths.

After the maximum permissible alteration for each element is determined, certain paths may be found which include at least one element for which no alteration is permissible. Such paths are excluded from further consideration for alteration.

(f) Identification of Minimum Incremental Cost.

Thereafter, the path having the minimum of the path incremental costs determined by the process described above is identified, and such path is denominated the "first" path for the purposes of this discussion.

(g) Determination of Required Alterations.

Then the required alterations of each steam transfer and supply means in the first path are calculated. This calculation includes a determination of the required pressure in the header in question; a determination of the alterations of each element which can be accomplished without altering the pressure in any header other than the header in question; and a determination of the effect of the permissible alterations upon the pressure of the header in question. If this determination leads to the conclusion that implementation of the alterations of the elements would result in attainment of the required pressure in the first header, then the alterations are carried out.

(h) Repetition of Steps (f)-(h).

However, if it is concluded that the required pressure at the first header would not be attained, the computer then selects a new path, for which the path incremental cost is the next lowest, with respect to the first path and repeats step f through h for the new path above for additional alterations until the total of the required alterations is determined to be sufficient to achieve the required pressure in the first header. However, it may be necessary to repeat the process for additional paths, and it may be found that even after all paths have been analyzed, it is impossible to alter the elements sufficiently to achieve the required pressure in the first header while satisfying all other constraints. If such is found, the required alterations are implemented, it being recognized that a pressure as close as possible to the required pressure has been achieved.

(i) Repetition of Steps (a)–(h).

After this process has been accomplished for the first header, it is repeated for each other header. When the steps have been completed for each header, the overall process is complete, until a pressure deviation is served at a header at which time the process is again initiated.

Figure 4:
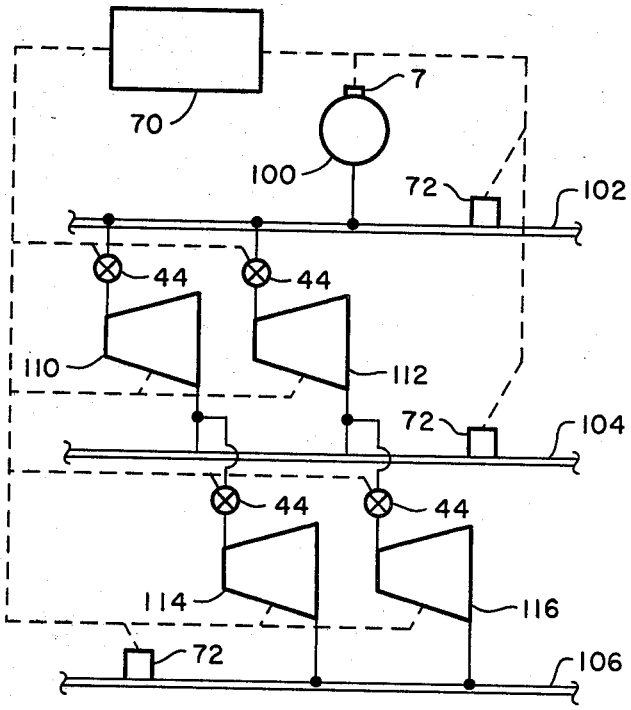
FIG. 4 is a schematic illustration of another steam generation and distribution system.

The following example illustrates the process described above. In FIG. 4 there is shown a boiler 100 and three headers 102, 104 and 106. Turbines 110 and 112 represent the first extraction stages of two turbines, not shown, and the turbines 110 and 112 are coupled between headers 101 and 104. Turbines 114 and 116 represent the second extraction stages of the two turbines not shown, and turbines 114 and 116 are coupled between the outputs of turbines 110 and 112 and header 106.

Figure 5:
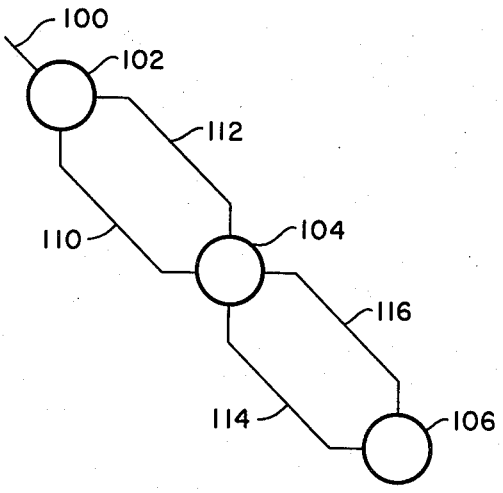
FIG. 5 is a schematic illustration of the network forming the system of FIG. 4.

The system in FIG. 4 can be conceptualized as the network shown in FIG. 5. Let us assume that the system is operating under the following conditions, and that the actual steam flow is exactly that required.

| Turbine | Gain | Steam Flow | Power |
|---|---|---|---|
| 110 | 50 | 50 | 2500 |
| 112 | 50 | 20 | 4000 |
| 114 | 40 | 100 | 1000 |
| 116 | 70 | 50 | 3500 |

In this case the "gain" is the electrical power in Kilowatt hours produced per unit of steam flow in pounds per hour, and "Power" is steam flow times gain.

Now let us assume that the pressure drops in header 106 so that an additional flow of steam of 10 pounds per hour is required. In this simple example, it is clear that the boiler 100 must produce more steam, and the computer need not select from a plurality of headers, nor does the computer need to determine incremental costs for the boiler, since the boiler is the only steam source. In this example, the only question is how the steam should be routed to produce the most electrical power from the additional 10 pounds per hour of steam. The present system solves the problem by accomplishing the steps described above.

Thus, the computer would first determine the incremental costs according to step (c) above. In this case the incremental "cost" would be the gains associated with the turbines and the "costs" would be negative since the turbines produce power. Since there is only one source of steam, it would be unnecessary to determine the cost associated with producing more steam. Then the computer determines, according to step (d), the permissible alterations for each turbine; and in this example it is assumed that there are no limitations upon permissible alterations. Likewise, according to step (e) it is assumed that no path is excluded. According to step (f) the path having the minimum incremental cost is identified. In this case the path includes turbines 110 and 116. Then, according to step (g) it is determined that the valves 44 associated with turbines 110 and 116 must both be opened to pass an additional 10 pounds of steam per hour. Once these determinations have been made, the steps are implemented according to step (g). Thus, an additional 10 pounds of steam would be routed through turbines 110 and 116, and the total power production is increased by 1200 units.

Thereafter, if the demand on header 106 drops so that the steam required therein decreases by 10 pounds, the computer again accomplishes the steps described above. In this simple example, it can be seen that the amount of steam flow through turbines 112 and 114 would be reduced by 10 pounds per hour. Thus the computer operates to reduce the cost of steam toward an overall least-cost solution.

Although in the present application the only steam transfer devices are turbines, it should be understood that other steam transfer devices are within the scope of the invention. For example, a pressure reducing valve-desuperheater for cooling steam and reducing its pressure is an appropriate transfer device. Also, the only steam suppliers discussed thus far are boilers; however, steam can be supplied to the present system from other sources. For example, the present control system can be applied to a steam distribution system which receives steam from a header which is not part of the system, and thus the header would be a steam supply means with respect to the control system.

I claim:

1. A process for controlling a steam generation and distribution system which includes a plurality of headers, each of said headers being coupled to steam-using devices which create demands for steam; supply means for supplying steam to each of the headers; and steam transferring devices to transfer steam between headers so that a plurality of paths is formed between the headers, the process comprising:

(a) measuring the pressure at each header;

(b) when the pressure changes from a first predetermined pressure at a first header, (i) identifying each path beginning at said first header and terminating at a steam supply means;

(ii) identifying each transfer means included in each said path;

(iii) determining the incremental cost associated with each transfer means and with the supply means in each said path;

(iv) determining the alteration of selected transfer means and steam supply means in at least one of said paths required to restore the predetermined pressure in said first header at the least total incremental cost;

(c) implementing the required alterations to restore the predetermined pressure in said header.

2. A process according to claim 1 further including the steps of:

(a) determining whether the pressure at any header other than the first header changes from a predetermined pressure;

(b) determining the alteration of selected transfer means and supply means required to restore the predetermined pressures in said headers, other than said first header, at the least total incremental cost; and (c) implementing the required alterations to restore the predetermined presure at said headers.

3. A process for controlling a steam generation and distribution system which includes a plurality of headers, each of said headers being coupled to steam-using devices which create demands for steam; supply means for supplying steam to each of the headers; and steam transferring devices to transfer steam between headers so that a plurality of paths is formed between the headers, the process comprising;

(a) measuring the pressure at each header;

(b) when the pressure changes from a first predetermined pressure at a first header;

(i) identifying each path beginning at said first header and terminating at a steam supply means;

(ii) identifying each transfer and supply means included in each said path;

(iii) determining the incremental cost associated with each transfer means and with the steam supplying means in each said path;

(iv) determing for each said path the total incremental cost for all transfer means and the supply means in each said path, this cost being the path incremental cost;

(v) determining the maximum permissible alteration for each transfer means and for the supply means in each said path;

(vi) excluding from further consideration those paths which consist of at least one steam transfer means or supply means which does not permit alteration;

(vii) identifying the path having the minimum path incremental cost determined in step (vi), said path being the first path;

(viii) determining the alteration of each steam transfer means and steam supply means in said first path required to completely or partially restore the predetermined pressure in said first header, without affecting the existing pressure levels of headers other than the first header;

(ix) repeating steps (vi) through (viii), until either (a) the total of required alterations determined by repeating steps (vi) through (viii) are sufficient to restore the first header pressure completely; or (b) all paths as determined by (i) are excluded from consideration at step (vi);

(x) implementing the total of required alterations to maintain a predetermined pressure at the first header;

(c) repeating the procedure of (b) for all headers of the said system sequentially one after another in a predetermined sequence.

4. A system to supply steam to steam-using devices at the minimum incremental cost, said system comprising:

(a) a high pressure header for supplying steam at a first predetermined pressure to at least one steam-using device;

(b) a low pressure header for supplying steam at a second predetermined pressure to at least one steam-using device;

(c) steam supply means to supply steam to said high pressure header, said means being controllable and having a known cost to supply steam;

(d) transfer means to convey steam from said high pressure header to said low pressure header, said transfer means having known incremental cost of transferring steam from said high pressure header to said low pressure header;

(e) sensor means to measure the steam pressure at each header;

(f) control means coupled to said sensor means to determine when the steam pressure changes from the first predetermined pressure and in response to a change to:

(i) identify each path beginning at said first header and terminating at a steam supply means;

(ii) identify each transfer and supply means included in each said path;

(iii) determine the incremental cost associated with each transfer means and with the steam supply means in each said path;

(iv) determine the alteration of selected transfer means and steam supply means in at least one of said paths required to restroe the predetermined pressure in said first header at the least total incremental cost; and (g) means to alter the supply and transfer means in said at least one path according to the determination of the control means.

5. A system according to claim 4, wherein the control means is constructed and arranged to:

(a) determine whether the pressure at any header other than the first header changes from a predetermined pressure; and (b) determine the alteration of selected transfer means and supply means required to restore the predetermined pressures in said headers, other than said first header, at the least total incremental cost.

* * * * *